United States Patent [19]

Bacchus et al.

[11] 4,440,000

[45] Apr. 3, 1984

[54] EVAPORATIVE COOLER

[76] Inventors: Rockney D. Bacchus; Richard E. Bacchus; Ronald A. Bacchus, all of 1401 Hawthorne, El Paso, Tex. 79902

[21] Appl. No.: 354,607

[22] Filed: Mar. 4, 1982

Related U.S. Application Data

[63] Continuation of Ser. No. 107,520, Dec. 27, 1979, abandoned.

[51] Int. Cl.[3] ..... F28D 5/00

[52] U.S. Cl. ..... 62/310; 261/29; 261/151; 55/509

[58] Field of Search ..... 62/304, 309, 310; 261/29, 103, DIG. 15, 151; 55/510, 498, 507, 509

[56] References Cited

U.S. PATENT DOCUMENTS

| | | | |
|---|---|---|---|
| D. 176,141 | 11/1955 | Katt . | |
| D. 213,695 | 4/1969 | Soroos . | |
| D. 226,914 | 5/1973 | Hoyle . | |
| D. 244,294 | 5/1977 | Glasoe . | |
| D. 256,388 | 8/1980 | Harrell . | |
| 445,667 | 2/1891 | Beacham . | |
| 2,319,565 | 5/1943 | Stratton . | |
| 3,127,256 | 3/1964 | Boylan | 55/351 |
| 3,319,793 | 5/1967 | Miller, Jr. et al. . | |
| 3,362,186 | 1/1968 | Patterson . | |
| 3,372,911 | 3/1968 | Herboldsheimen | 62/304 |
| 3,583,174 | 6/1971 | Logue . | |
| 3,867,486 | 2/1975 | Nagele . | |
| 4,026,971 | 5/1977 | Glasoe . | |
| 4,029,723 | 6/1977 | Morrison et al. | 261/29 |
| 4,043,777 | 8/1977 | Parren . | |

*Primary Examiner*—Edward G. Favors
*Assistant Examiner*—Henry Bennett
*Attorney, Agent, or Firm*—Bacon & Thomas

[57] ABSTRACT

An evaporative cooler according to the invention comprises a one-piece, three-layer pad wrapped around an open-sided cylindrical barrel-like structure. Water is sprayed uniformly over the interior surface of the pad while a centrifugal blower draws air in through the pad from the outside. A novel base design renders it possible to replace the standard square base coolers with the cooler of the present invention. The cooler can be used either with downward or side delivery systems and can easily be adapted to being mounted in a window. The top, base, and barrel are separately fabricated of a non-heat conducting material and are so shaped that they can be nested or stacked for economy of space in storage or shipping.

9 Claims, 17 Drawing Figures

EVAPORATIVE COOLER

This application is a continuation of application Ser. No. 107,520, filed 12/27/79, now abandoned.

BACKGROUND OF THE INVENTION

At theorical perfection, evaporative cooling is an adiabatic process. Incoming air passes through a humidifying medium and evaporates water into the air stream. Water molecules take on heat and achieve the change from a liquid to a gaseous state and sensible heat is converted into latent heat. The process reduces dry bulb temperature over a constant wet bulb temperature. The wet bulb temperature is the limit on direct evaporative cooling. It is the full saturation temperature and is the theoretically coolest to which direct evaporation can reduce the temperature.

Years of research and engineering skill in the art have evolved the conventional square metal evaporative cooler. Automated factories now produce square metal units extremely fast and accurately at a relatively low direct cost. However, while engineers have precision-tuned this art to its apparent ultimate productive capability, there does not appear to have been any practicle, fundamental advances in the design of evaporative coolers.

Conventional evaporative coolers predominantly attempt to use the evaporative process by means of a foursided metal design. Typically, four (three on side-drafts) removable pad holders contain an evaporating medium (the "pad" ) which is usually made of aspen fibers. The pad holders are provided with a rigid exterior and use wire grids to sandwich the pads to hold them in place. Water distribution is usually accomplished by copper lines feeding a set of distribution troughs or, as in U.S. Pat. 3,867,486, a plurality of fluid supply channels. The units have generally been made of light guage metal, preferably galvanized to reduce rust. Conventionally, the top and bottom are permenantly connected by a set of corner struts which also support the removable pad holders. A forward curved centrifugal blower is generally to draw air through the pads and exhaust it into the area to be cooled.

Annual maintenance required removing all of the pad holders and individually cleaning the pads, in addition to performing a general lubrication of the blower and motor to extend the life of metal parts. It was necessary to clean out rust and scale deposits and then recoat the metal in some manner with a water-proof or corrosion resistant coating.

Major problems in maintaining a high evaporative efficiency have been in keeping the pads sealed and saturated. Open areas allow unsaturated flow as do dry areas. Since these areas offer less resistance to air flow, the velocity of air through them tends to be higher and adjacent saturated areas also become partially dry. Thus a major objective of pad and water distribution design improvement has been to obtain good seals on pads and keep them evenly and well saturated.

Shipping has of necessity been of completely assembled units. The need to secure the top and base together made nestable shipping impractical. Assembly by unskilled persons without highly specialized equipment was considered impossible or economically impracticle and thus it was necessary to ship a large amount of "air" in the assembled units at a cost that became very significant with longer and, especially, overseas shipment.

Although some improvements have been made in square coolers, a small number of prior art round coolers continue to be made and these were beset by difficulties with mass production methods and by metal waste problems. These problems have been overcome by the present invention which provides an evaporative cooler having an even air flow and high saturation efficiency, combined with compact and nestable shipping.

Accordingly, a principal object of this invention is to provide an evaporative cooler having an increased effective pad area capable of being uniformly and more effectively saturated with water. Another object is to provide a pad having no unsealed areas and in which such unsealed areas are eliminated by preventing the wet pad from sagging once it is placed in the cooler. Still another object is to provide for increased pad area by providing a pad having no corners and fewer seams. Yet another object is to provide an evaporative cooler in which the pad is made of a single piece and is capable of rapid changing. Another object is to provide an evaporative cooler in which there is no possibility or danger of water overflowing into the occupied areas below. Still another object is to provide such a cooler which does not require a level surface for operation. A further object is to provide an evaporative cooler which does not require periodic maintenance to remove rust and mineral collections and in which the cooling efficiency is not diminished by parts heated by the sun. Yet a further object is to provide an evaporative cooler which is capable of nestable assembly.

These and other objects which will become apparent to those skilled in the art are achieved in accordance with the present invention as described in the following specification and in the accompanying drawings.

SUMMARY OF THE INVENTION

In accordance with the present invention, an evaporative cooler is provided using a novel pad-holding system in which a three-piece sandwich arrangement holds the pad firmly in place. The interior section is a rigid, barrel-like structure preferably made of a non-corrosive material such as fiberglass. It is entirely self-supporting and has angular openings to secure the pad firmly in place. The middle section of the sandwich is a roll of good evaporative medium such as aspen pad or paper excelsior, such as is common in the art for this purpose. The outer section is a flexible net that can be wrapped around the pad and pulled tightly over the latter by means of a number of tension belts. The angular weave on the sides of the cylindrical barrel are in the form of narrow, rigid struts which provide a maximum area for the passage of air and also permit the pad to slightly bulged through the openings. The effect of this bulging is to prevent accidental slipping of the pad with the result that open areas would be formed through which air would pass without picking up water. The pad can be made of aspen fibers, paper excelsior, or other good evaporative mediums such as are commonly used for this purpose. The pad is made in sufficient length so that the ends overlap to eliminate any gaps in the seams. The exterior netting wraps around the paid and sandwiches it in place against the rigid barrel-like structure. A number of tightening belts are used to pull the netting firmly and tightly around the pad.

Water is distributed to the pad through a perforated pipe so constructed as to distribute the water uniformly over the interior surface of the pad, as will be described in greater detail below. The cylindrical barrel rests in a base which is also made of a corrosion resistant material, such as fiberglass. The outer rim of the base has an outward slant to facilitate drip collection. The base then tapers inwardly and is joined to an octagonal section whose purpose is described in greater detail below. The lowermost portion of the base is flattened out to form a water pan. A central air shaft on the base provides for mounting a centrifugal blower. The blower draws air in from the outside through the wet pad and, in one aspect of the invention wherein the cooled air is delivered downwardly into the occupied areas of the building, the output of the fan is connected directly to the air shaft. In another preferred aspect, cooled air is delivered to a duct connected to the side of the cylindrical barrel. In this instance, one side of the barrel is provided with an adapting structure whereby a sideward extending duct can be connected to the cooler. This will also be described in greater detail below.

The above described structure is provided with a dome-shaped top also constructed of a corrosion resistant material such as fiberglass. The top has an outwardly flared lip to facilitate unassembled shipping.

DETAILED DESCRIPTION OF THE INVENTION

The invention will now be described in detail, reference being made to the accompanying drawings in which.

Figure 4:
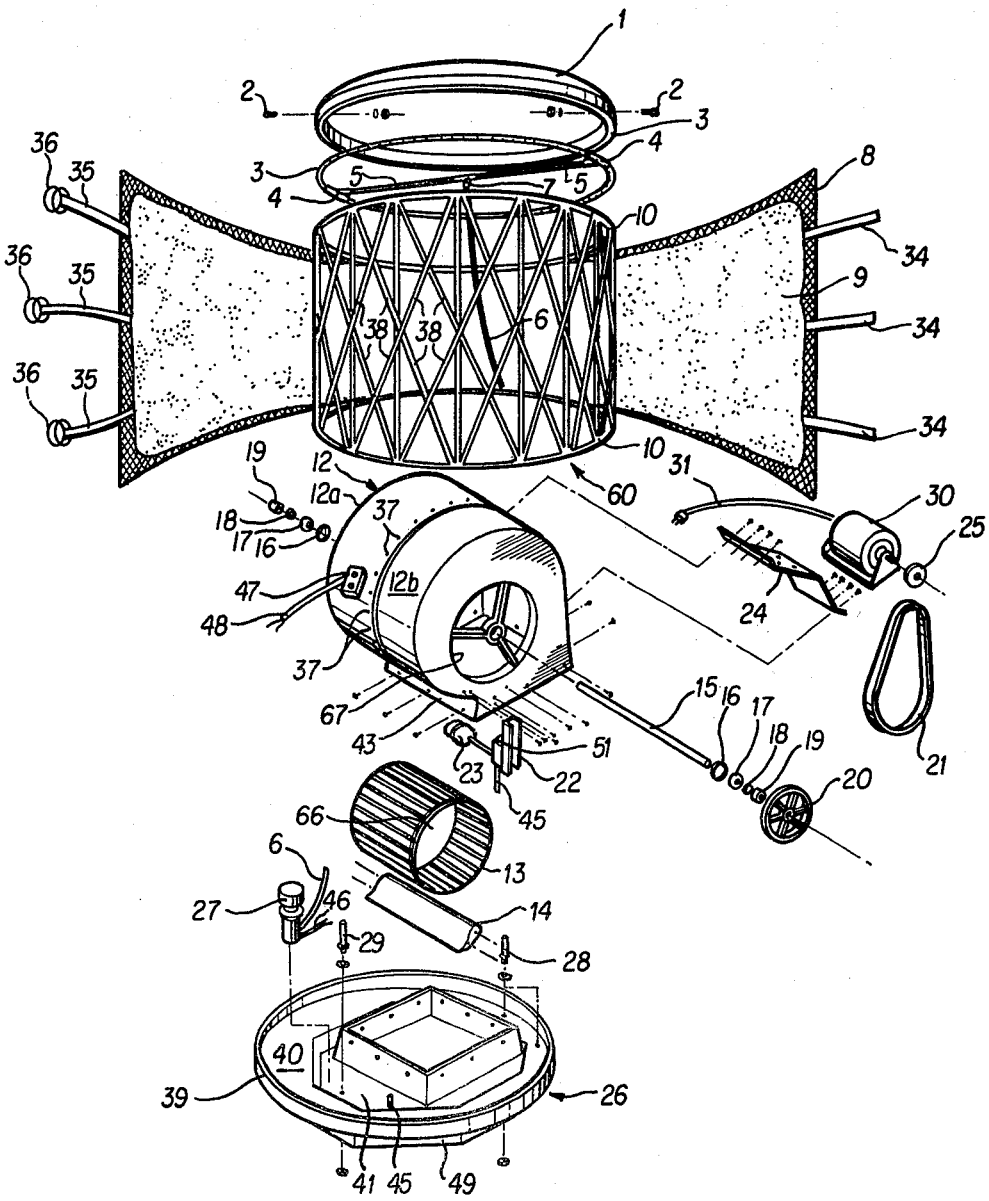
FIG. 4 is an exploded view showing all of the components of the down draft model.
Figure 5:
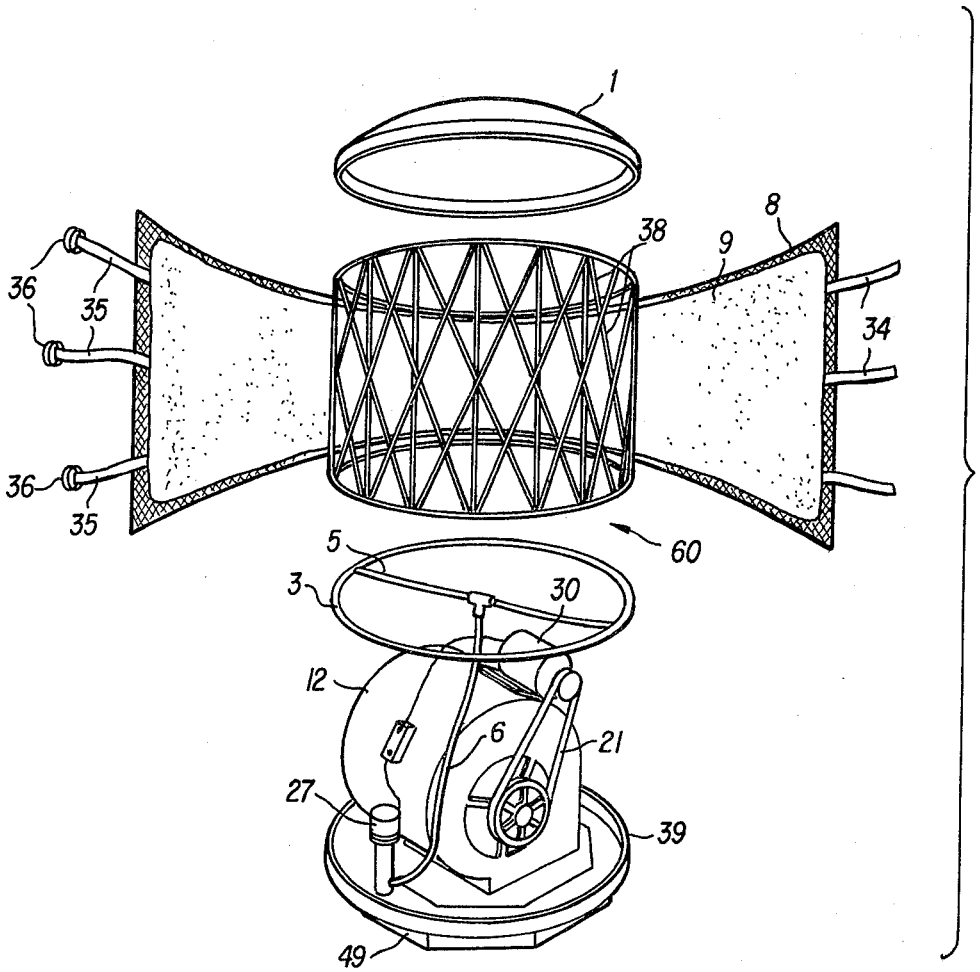
FIG. 5 shows a partially exploded, partially assembled view of the down draft model showing in clearer detail the relative location of the centrifugal blower with respect to the base and the barrel-like structure.
Figure 12:
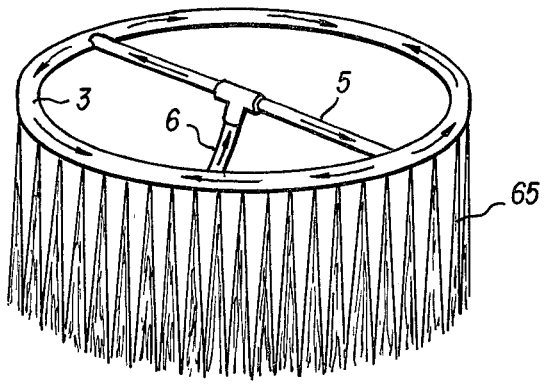
FIG. 12 shows the arrangement for providing a uniform delivery of spray in the down draft model.
Figure 8:
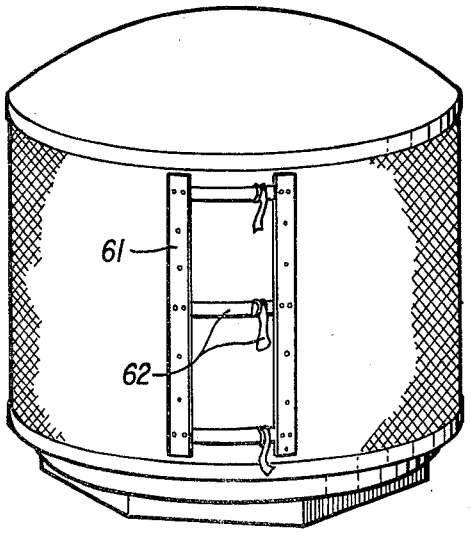
FIG. 8 is a front elevation of the completely assembled down draft model showing the pad buckled in place.

Referring now to FIGS. 4 and 5, it will be seen that the pad assembly comprises a rigid cylindrical, barrel-like, pad support structure 60, an absorbent pad 9, and a pad retainer or covering net 8. The barrel is provided with annular top and bottom end members 10 and rigid, rod-like struts 38. Pad 9 and net cover 8 are of sufficient length so that, when wrapped around barrel 60, there will be a slight overlap as shown at 62 in FIG. 8. One side of the cover is provided with a plurality of straps 34 while the other side is provided with a similar number of straps 35. These straps can be attached to the net cover 8 in any suitable fashion such as by means of the rigid bars 61 indicated on FIG. 8. Attached to each one of straps 35 is a pair of rings 36 which, in combination with strap 34 permits securing the pad and cover securely to the surface of barrel 60, thereby tightly sandwiching the pad 9 against the open faced structure of the struts 38 on the barrel.

Figure 1:
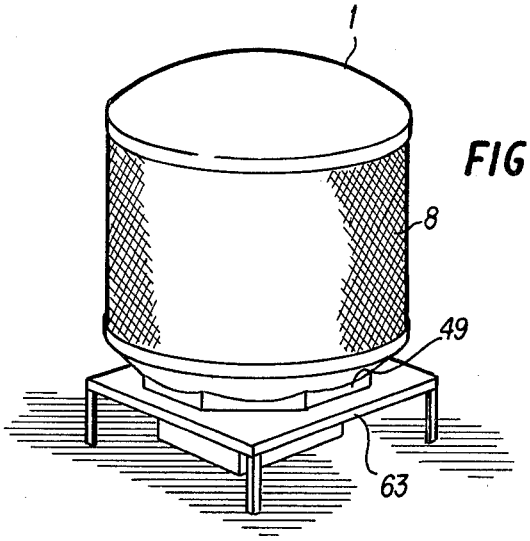
FIG. 1 shows one preferred aspect in which the cooled air is delivered downward (the "down draft" model).
Figure 2:
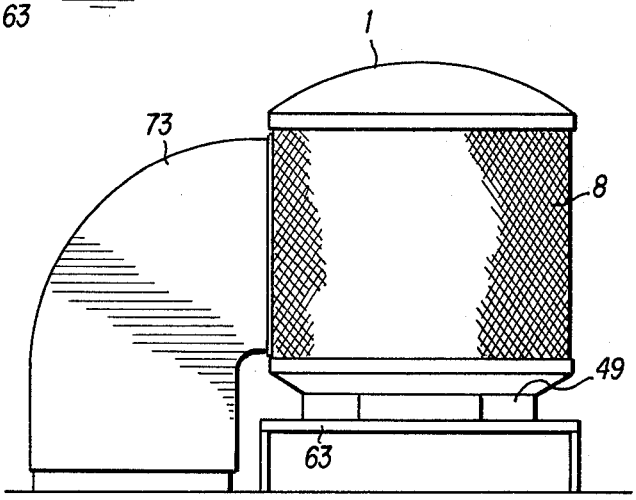
FIG. 2 shows a second preferred aspect in which the cooled air is delivered sidewards (the "side draft" model).
Figure 10:
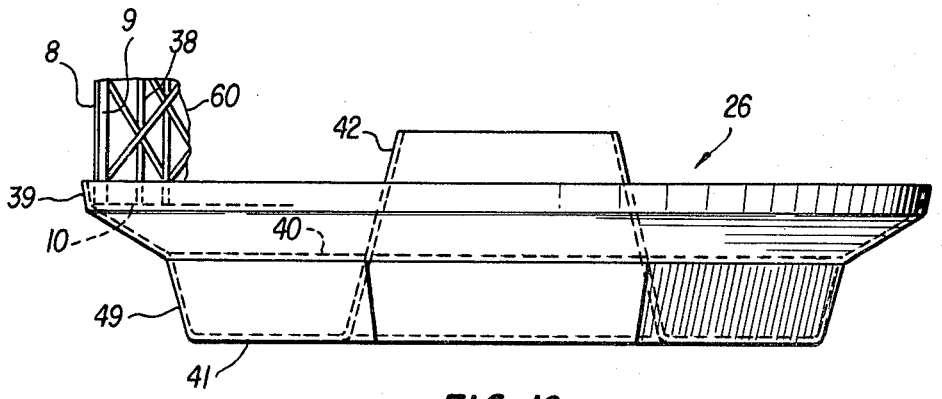
FIG. 10 is a front elevation of the novel base of the down draft model.
Figure 11:
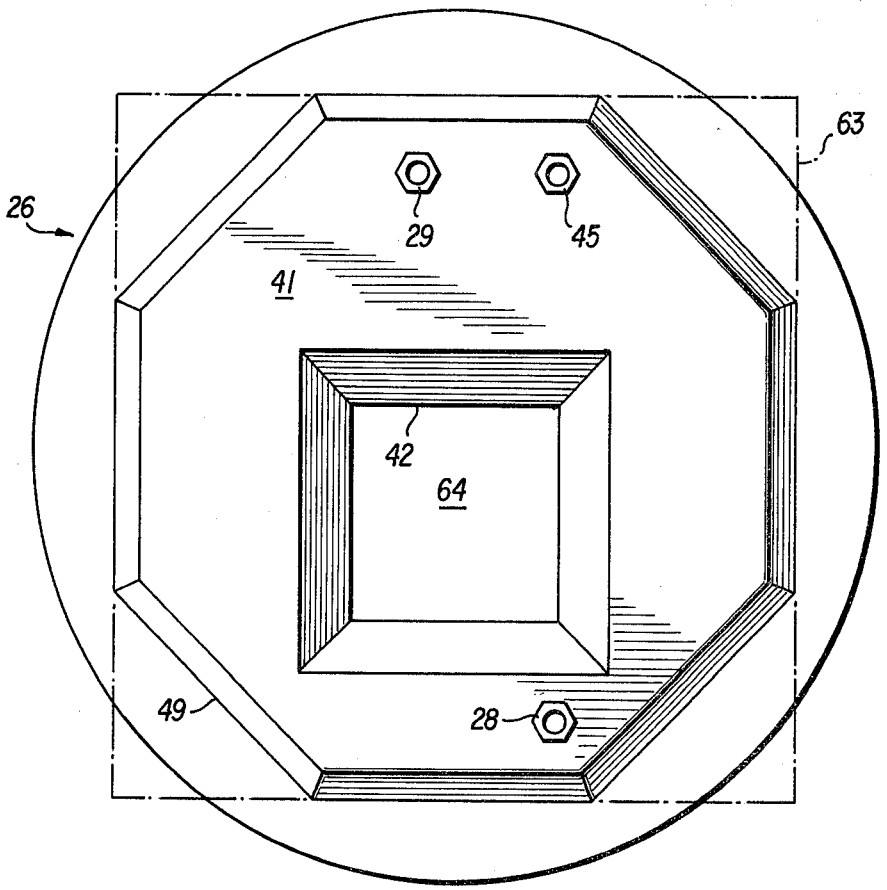
FIG. 11 is a bottom view of the base shown in FIG. 10.

The assembled barrel and pad combination rests on base member 26. Referring to FIGS. 1 and 11 the base 26 is shown to be provided with a lowermost inner bottom surface in the shape of on octagonal outline 49. In use, the lower octagonal portion 49 rests on the conventional square base 63 as seen in FIG. 1. The sides or facets of the octagonal outline is such as to adapt the novel base to the conventional square support structure which is shown in outline in FIG. 11 by means of the broken line 63. An opening 64 in the base fits over the air duct (not shown) which leads from the cooling unit into the interior of the dwelling or other structure to be cooled. As shown in FIGS. 4 and 10, the base member is provided with an outwardly tapering rim 39 in the form of a lip to facilitate the collection of any water dripping down the sides of the pad assembly. As can be seen from FIG. 10, the outer surface of the netting 8 is within the perimeter of the lip 39. The rim then tapers inwardly to meet the facets of the octagonal base 49. Base 49 itself tapers inwardly until it assumes the dimensions of the standard, conventional square base 63. The octagonal sides taper inwardly to flattened bottom portion 41 which serves as a water pan. A short pipe 29 is mounted in a depressed portion of the pan to provide for overflow drainage. An inwardly tapering central air shaft 42, integral with the flat portion 41, rises from the latter. As shown in FIG. 10, the central air shaft 42 extends to a point above the rim 39 of the base. The outward taper of rim 39 not only provides for catching any possible water run-off, but also in cooperation with the inward taper of the central shaft 42 makes it possible to stack the bases in nested groups for shipping or storing. The octagon shape of the base does not necessarily have to be equalateral; but short sides are necessary to fit the square base within the outside perimeter of the drip collector. Thus, the octagon design combines a standard size base with a shippable sized diameter. The short sides also permit close containment installations such as on apartments, windows and the like.

Referring once more to FIGS. 4 and 5, the fan 12 is seen mounted over the central opening 42 to provide a down draft delivery of cooled air into the building below. Thus, as seen in FIG. 4, the output of the fan is provided with a nozzle-like portion 43 which fits over the air shaft 42 and can be secured to the shaft by any suitable means such as bolting. The fan body itself can suitably be constructed in two portions 12*a* and 12*b* to facilitate storage and shipping and then assembled for purposes of installation. The impeller portion of the fan is of novel construction. Thus, the cage 13 is provided with a central radial baffle 66 which causes air drawn in through central opening 67 to be more uniformly distributed over the central air shaft and thus, provide a more uniform and less turbulent flow. The fan is driven by means of motor 30 mounted to the body of the centrifugal fan by means of bracket 24. The impeller 13 itself is mounted in conventional manner on keyed shaft 15 and is driven by the motor by means of belt 21 passing over pulleys 25 and 20.

Electrical power for driving the motor is provided through wire 31 which plugs into outlet 47 mounted on the casing of the centrifugal blower. Outlet 47 is itself connected to the exterior of the cooling unit through water tight conduit 28 mounted in the base 26. Water enters the base through pipe 45 which is connected to a float valve 51 controlled by float 23. The float and valve are mounted in any suitable manner on the base such as by means of bracket 22. The float valve permits the pan 41 to be filled to a predetermined level. The water in the pan is then pumped by means of water pump 27 through pipe 6 to the water distribution system at the top of the barrel.

It will be evident from the arrangement of the split fan 12*a*, 12*b*, and in particular the divided cage 13, that the movement of air through the pad 9 and the struts 38 of the barrel will tend to be equalized on opposide sides of the assembled barrel and pad combination, particularly in view of the generally centralized location of the fan housing within the generally circular barrel 60. In effect, the central radial baffle 66 divides the fan into two units for creating a more uniform intake of air within the evaporative cooler. A combination of the divided cage 13 with the generally round configuration of the assembled barrel 60, pad 9 and netting 8 places all of the evaporative pad at a generally uniform distance from the two sides of the intake of the cage 13.

Figure 13:
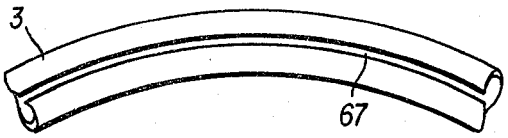
FIG. 13 shows one form of water delivery pipe in which a single, circumferential slit is provided in the pipe for uniform distribution of water to the inside surface of the pad.
Figure 14:
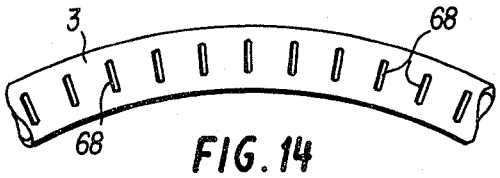
FIG. 14 shows an alternative means of providing a uniform spray in which a plurality of parallel, transverse slits are made in the surface of the pipe.
Figure 15:
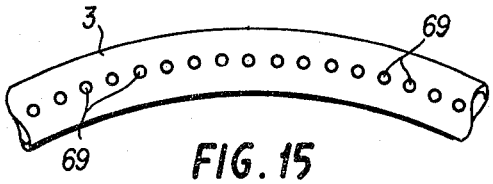
FIG. 15 shows still another alternative means for uniformly distributing the water from the delivery pipe in which a plurality of circular perforations are provided in the surface of the pipe.
Figure 16:
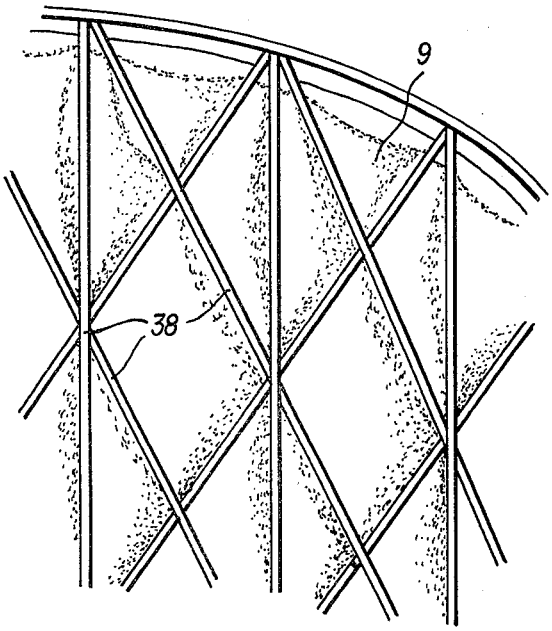
FIG. 16 is a view from the interior of the assembled cylindrical barrel and pad showing the pad bulging through the strut-like structure of the barrel.

Still referring to FIGS. 4 and 5, it will be seen that pipe 6 is connected to a T-fitting 7 which in turn is connected to two pipes 5 extending in opposite directions. The ends of pipes 5 are themselves connected to separate T's 4 which feed semi-circular pipes 3. These pipes are provided with downwardly facing openings to spray water uniformly on to the inner surface of the pad 9. Depending on the volume of water which it is desired to spray, the openings can be made in three optional designs. Thus, as seen in FIG. 13, the water can be sprayed through a single circular slot 67 coextensive with the pipe 3 itself. A second optional design is shown in FIG. 14 in which a series of parallel slices 68 are provided around the lower perimeter of the pipe 3. Finally, in FIG. 15 there is shown a third design consisting of a plurality of small holes 69 extending around the lower perimeter of the pipe and coextensive therewith. As will be apparent to those skilled in the art, the just described arrangement provides a closed system in which water is sprayed under pressure by means of pump 27. This ensures that a uniform spray of water 65 issues from the openings in pipe 3 to uniformly wet the inner surface of the pad 9. In this manner, because the pad completely encircles the barrel 60 and has overlapping ends, as well as being fastened by tension straps 34 and 35, the evaporator can provide the maximum possible cooling because at no point will air enter the system through open areas not covered by the saturated pad.

To control the amount of air blown into the dwelling or other building, and to shut off the flow of air completely, there can be provided a cut-off or damper 14 mounted in any suitable fashion on a shaft (not shown) extending through the complete structure to the outside. The cut-off may be manipulated by means of a handle (also not shown) attached to the shaft in the usual manner of controlling dampers in air conditioning ducts.

In another preferred aspect of the invention, the evaporative cooler described above can be modified to serve a duct system where air delivery from the cooler must be from the side of the device.

Figure 7:
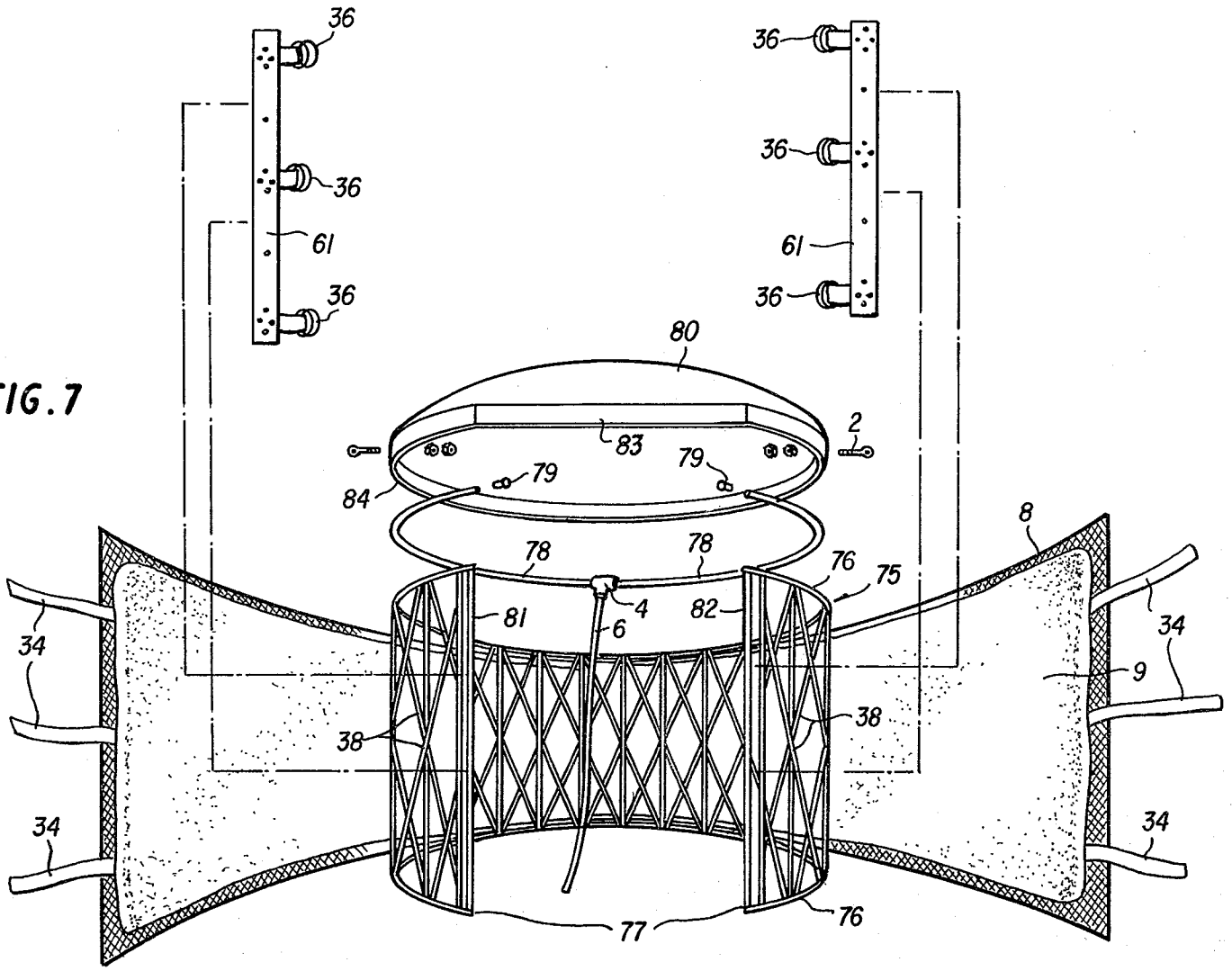
FIG. 7 is an exploded view of the remaining portions of the side draft model, including the cylindrical barrel, pad, water delivery system and the means for securing the pad.
Figure 9:
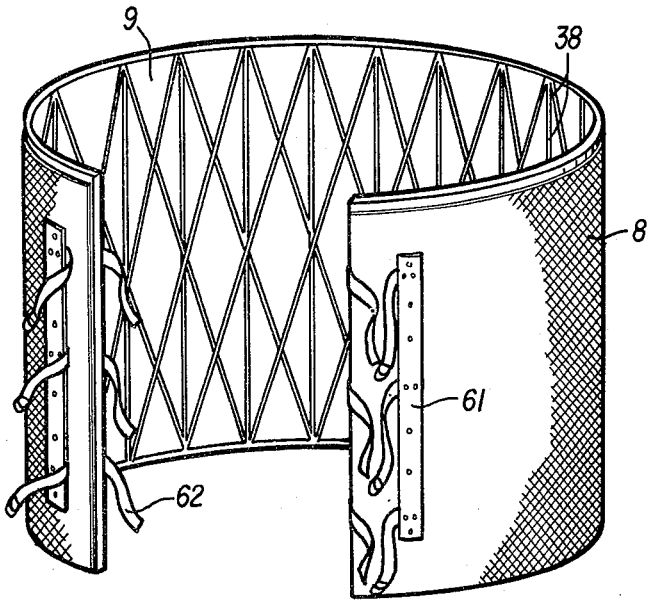
FIG. 9 is a view of the side draft barrel with the pad and netting attached showing one method for attaching the netting to the rigid structure of the barrel.

To adapt the device of FIGS. 1 and 4 for side draft delivery, one must imagine a cutting plane disposed vertically and parallel to the axis of cylindrical barrel 10 intersecting the cylinder at a point closer to the axis than the length of the radius. The cylindrical barrel designated 75 in FIG. 7 thus acquires an opening side as indicated by 77. The barrel 75 is in otherwise all respects similar to the barrel 10 of FIG. 4. Thus, the barrel 75 is provided with top and bottom end portions 76 to render the structure rigid and with struts 38 which are similar to the struts 38 in FIG. 4. Water is supplied to the barrel through pipe 6 connected to T-fitting 4. However, because of the presence of opening 77, the pipe through which the water is sprayed on to the pad must coincide in length with the length of end 76. Thus, two pipes 78 are connected to the ends of T-fitting 4 and are provided with end plugs 79 to prevent the water from coming out the ends. Again, as in the case of pipe 3, the pipe 78 can be provided with openings similar to those designated as 67, 68 and 69 in FIGS. 13, 14 and 15, respectively. The pad 9 and mesh cover 8 are similar to those used for the device shown in FIG. 4, except that they must be somewhat shorter to cover only the remaining portion of the barrel. The pad and mesh cover can be secured to the barrel in a manner generally similar to the means for securing it in the case of the model shown in FIG. 4. One such means is illustrated in FIG. 7. As can be seen from FIG. 7, both ends of the mesh cover are provided with similar straps such as straps 34. The rings 36 are mounted on brackets 61, one bracket each being mounted on sides 81 and 82, respectively, of the opening in the barrel 75. The straps 34 are then threaded through their matching rings 36 in the usual manner and pulled tight. Since the side of barrel 75 opens into a sideward extending duct, no portion of the barrel remains uncovered by the pad thus making it impossible for air to be drawn into the system anywhere but through the saturated surface of the pad. The cover 1 shown in FIG. 4 is modified accordingly, to accommodate the altered shape of the barrel 75. Thus, the cover designated 80 in FIG. 7 is provided with a flat section 83 corresponding in length to the length of the opening 77. As in the case of cover 1, both the flat portion 83 and the curved portion 84 of cover 80 are tapered outward to permit stacking for shipping and storing purposes.

Figure 6:
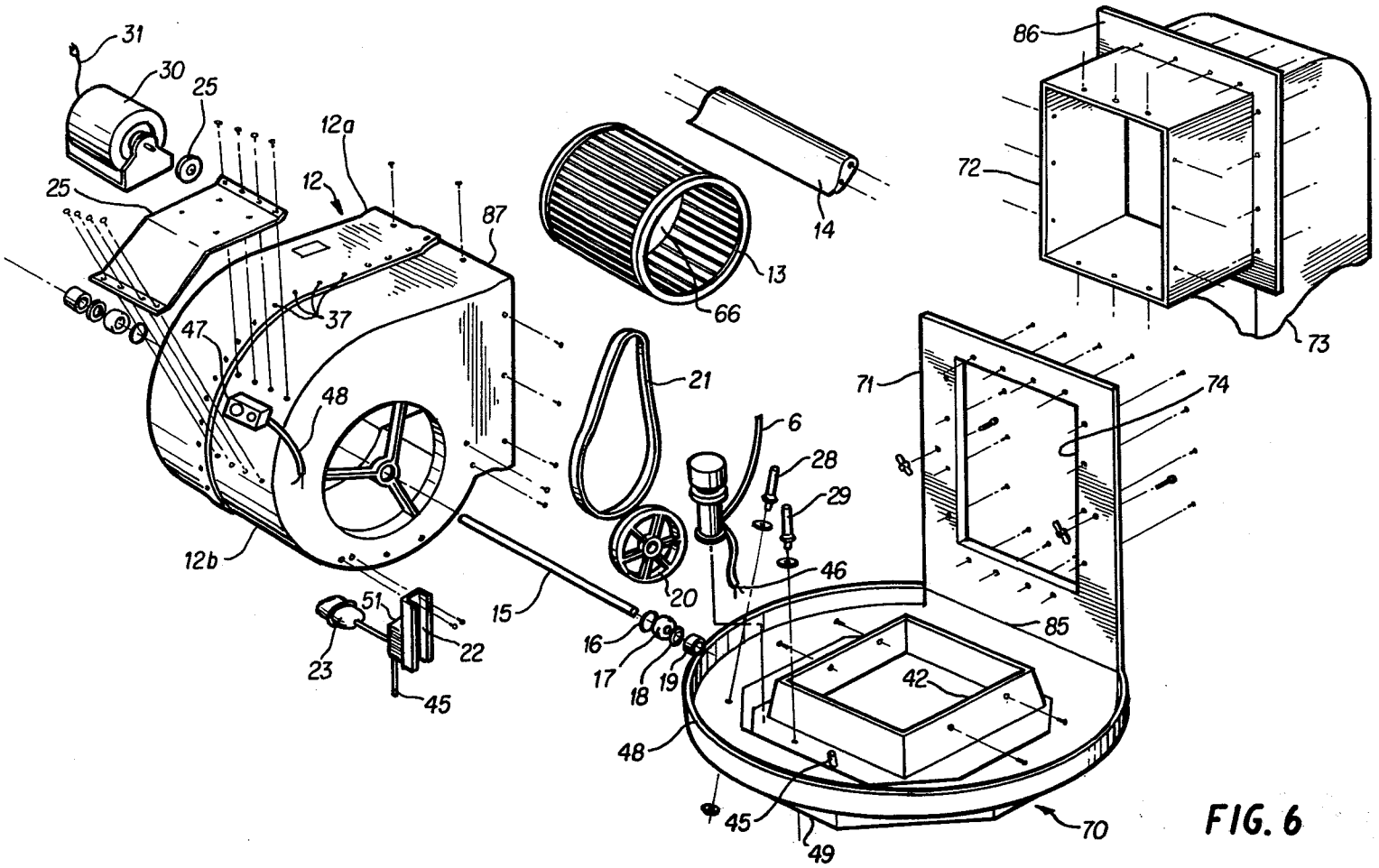
FIG. 6 is an exploded view of a portion of the side draft model of FIG. 2 showing the base, blower, and means for adapting the cooler for the side delivery of cooled air.

Referring now to FIG. 6, it will be seen that the base 70 and its rim 84 have been modified to have a flat portion 85 to correspond to the opening 77 in barrel 75. Retained from base 26 in FIG. 4 are the octagonal portion 49 and the central duct 42, including the electrical and water connections, and the float valve assembly comprising bracket 22, valve 51 and float 23. However, the central duct 42 is not used in this instance to provide a connection for air flow. As seen in FIG. 6, the base 70 is provided with an upstanding adapting portion 71 provided with a rectangular opening 74 which accommodates duct 72. Adapting plate 71 is of the same width as the flat portion 85 of base 70 and can either be made integral with the base or attached to it mechanically in any suitable fashion. Centrifugal blower 12 can be the same as that used in the down draft model of FIG. 4 except that it will be mounted on duct 42 so that the output nozzle end 87 is in a vertical plane to connect with the end 72 of duct 73. The fan housing can be secured to the duct 42 in any suitable manner such as by appropriate brackets (not shown) within the skill of any mechanic. The nozzle end of the fan housing can be secured to the portion 72 of duct 73 in any suitable manner as by means of screws or rivets while the base 70 itself and adapting plate 71 can be secured to plate 86 in a similar manner. A cut-off or damper 14, similar to that shown in FIG. 4, is also provided for the modification shown in FIG. 6 and can be placed between the impeller cage 13 and the end of duct 72. As in the case of base 26 in FIG. 4, base 70 has an outwardly tapering rim 84 and an inwardly tapering central duct 42. Thus, it is possible to ship or store these bases in a stacked or nested position thus occupying a minimum of space.

Figure 3:
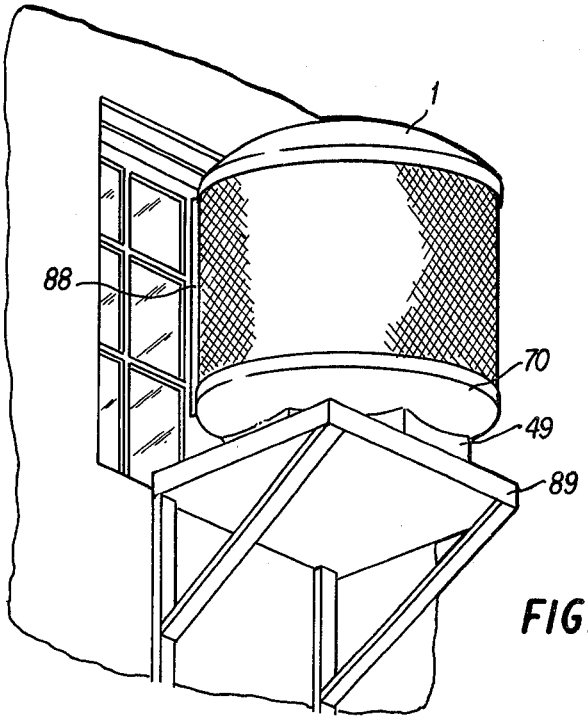
FIG. 3 shows an adaptation of the cooler for installation in a window.
Figure 17:
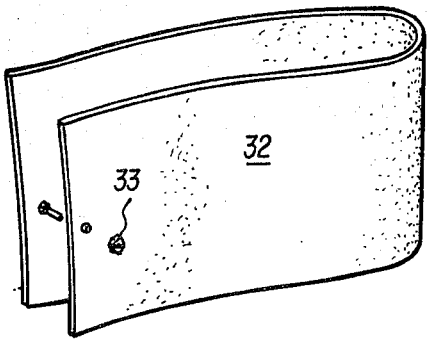
FIG. 17 shows a cover which can be used for the structure when it is intended to be shut down during the winter months when cooling is not needed.

The side draft delivery model described in FIGS. 6 and 7 can readily be adapted to be mounted in a window. Such mounting is shown in FIG. 3. As will be seen from FIG. 3, the octagonal portion 49 of base 70 of the side draft cooling unit is mounted on an exterior platform 89. Instead of adapting plate 71, the device can be provided with an expandable neck and built in window seal similar to those used in window mounted air conditioning units. Such an expandable neck is shown in part at 88 in FIG. 3.

An important feature of the present invention is the high volume water flow and distribution during start up of the cooler. High volume of water supply and distribution will quickly saturate the pad to achieve a quicker cooling effect. Also, by providing more water than will initially evaporate from the pad, some of the water will return to the pan and be recirculated by the water pump. This results in giving the cooler a cooling tower effect and the water will more rapidly approach the water bulb temperature as it is recirculated. Since high speed is usually required on initial cooling, a two speed water pump is used to enhance start up efficiency. This is accomplished by wiring the two speed water pump to the same control as the blower motor so that they both operate at corresponding levels. This is accomplished by connecting both the motor lead 31 and pump lead 46 to a common source of power 47 which in turn is connected by means of line 48 to a two speed control (not shown). Such two speed controls are commonly available through electrical supply sources.

Among the advantages noted for the evaporative cooler described in detail above, or the fact that the cylindrical shape of the barrel makes it possible to present a maximum evaporating area to the air drawn in by the centrifugal fan. As a consequence, only one pad is needed for ordinary use making it simple and rapid to change when needed. For industrial size installations where the barrel has a large circumference, it may be advantageous to use two pads and have them connected end to end. Conventional coolers currently in use, having flat sides and corner framework require four or eight pads to cover the exposed area. Thus, the cooling unit in accordance with the present invention greatly reduces the time needed for periodic maintenance.

Furthermore, because one element of the pad sandwich is the permanent, rigid, cylindrical barrel section, maintenance becomes more economical because all that must be disgarded is the absorbent pad and its mesh cover 8, rather than the entire sandwich as in the case of prior art units wherein both faces of the sandwich including the central absorbent pad must be disgarded. The unique pad holding system of the present invention eliminates the need for side supports since it is fully self-supporting. Thus, as already described, the tension straps 34 and 35 force the pad through the angular openings in the barrel, holding the pad in place and preventing open air gaps caused by pad slippage.

Among the cost savings achieved by the present invention which result from the elimination of the side overlaps is the fact that, for the same pad face useful area, less total pad is needed and a multiplicity of corner supports are eliminated. Because the down draft model requires only a single set of buckles (two sets on the side draft model) obstruction to the flow of air is reduced to a minimum and the strap and buckle combination permits a long tightening pull to ensure that the pad bulges through the angular opening in the barrel and will not slip. The round cylindrical design is aerodynamically most efficient since it allows air to flow more evenly thus aiding in the even water distribution. However, it should be noted that the barrel can be produced in oblong or other shapes and still perform efficiently as long as it has a continuous curve to allow for even pad tightening.

Another major and unique advantage is the fact that the water distribution system is sealed. As described in detail above, rather than being sprayed through a nozzle, the water flows under pressure from openings in the side of the distribution hose. The shape and size of the outlet openings can be preselected and calibrated to suit the particular needs of the installation. A closed end distribution pipe permits a pressure build up should some of the perforations become clogged or if an oversized pump is used. Force feeding thus helps maintain a continuous flow and consistently wet pad, as well as permitting water to be pumped to higher areas and eliminating a restricted range of mountings because an absolutely level trough is not necessary under the circumstances.

As in the case of all evaporative cooling, an excess of amount of water can increase friction through the pad while excessive humidity can be less comfortable than a slightly higher dry bulb temperature. Accordingly, as with all evaporative cooling installations, thermostatic and humidity controls (not shown) should be included for maximum comfort and efficiency. The means for installing such controls are well within the skill of the art and need not be described in detail.

Although use of non-corrosive materials, such as fiber reenforced plastics, have previously been attempted, a unique feature of the present invention is the use of non-heat conductive materials. In accordance with the present invention, substantially all of the assembled unit is non-metallic and made of non-heat conducting materials except the blower assembly itself. The use of non-conducting material in the air conditioning field is a novel approach which avoids high losses due to solar heat, particularly in areas such as the southwest where evaporative cooling is a major means of air conditioning.

Another major advantage of the present invention is that the device can be shipped unassembled. As described in detail above, the several components associate as to make nesting and stacking convenient with the result that many units can be shipped and stored at one time.

Although the barrel has been described above as a single unit, it can be produced as nestable pieces. Thus, for small installations, the barrel can be produced in two semi-circular sections with fastening edges that can interlock for rapid assembly. By making the barrel in sections that element also, in addition to the tops and bases, can be stacked and nested for purposes of efficient shipping or storage. For larger installations, the barrel can be made in any number of conveniently sized segments. The dimensions of any given unit will, of course, vary with the volume of air which is it required to move in a particular installation. Those skilled in the art can easily determined the required area for the saturated pad from such known factors as air flow speed, the characteristics of the blowers to be used, and the volume of water which it is desired to evaporate. By way of illustration, prior art coolers having square bases of 28, 34, or 37 inches can be replaced by a cooling unit in accordance with the present invention having a diameter of 35, 45, or 55 inches, respectively.

Although three preferred modifications of the invention have been described in detail above, these have been for illustration purposes only. Other modifications falling within the scope of the invention will readily suggest themselves to those skilled in the art. Accordingly, the present invention is not limited except as define in the claims which follow.

What is claimed is:

1. In an evaporative cooler including horizontal, dish-like, generally circular base and cover members; a vertical evaporative pad substantially enclosing, with said cover members, an interior volume of the cooler; air inlet and outlet openings communicating with the interior of the cooler; a blower means, including a drive motor, within the cooler for circulating air through the inlet and outlet openings; and means for continuously supplying water to the upper end of the evaporative pad during cooler operation; the improvement comprising:

a rigid self-supportive, generally cylindrically curved evaporative pad and cover member having air flow openings therethrough, said pad and cover support member extending between said base and cover members, and comprising the sole means for structurally supporting the cover member above the base member; said airflow openings being separated by narrow, elongated rod-like elements;

a flexible elongated, fibrous, saturable evaporative pad wrapped around the outer periphery of said pad and cover support member and in engagement with the pad and the cover support member;

an elongated, continuous flexible foraminous pad retainer having free ends wrapped around the evaporative pad and the pad and cover support member, said free ends being secured under tension by means of a releasable connector means;

said pad and cover support member comprising the sole means for structurally supporting the cover member above the base member, and comprising a one-piece, curved, semi-rigid element formed of an open mesh network of narrow, rod-like elements;

said base member including said air outlet opening which extends downwardly therethrough;

an inwardly and upwardly tapered flange surrounding said outlet opening;

an upstanding rim defining the periphery of said base member;

said flange terminating above the upper edge of said rim;

said blower and blower motor secured to said flange and extending upwardly therefrom;

said base member adapted to retain a layer of water between said rim and said flange;

said blower having an air discharge opening in communication with said air outlet opening and an air intake opening communicating with the interior of the cooler;

said blower comprising a centrifugal blower including a cylindrical, cage-like rotatable impeller having an imperforate central baffle extending radially across the interior of the impeller to divide the blower into two opposed sections.

2. Appartus according to claim 1, said rim being outwardly flared away from the pad retainer.

3. Appatus according to claim 2, said base member including, between said rim and said flange, a continuous inner bottom surface that includes a central, lowermost, water receiving, horizontal area disposed beneath said rim, and an upwardly sloping surface connecting the edge of said central area and the bottom of said rim, said pad and cover support member engaging said base member adjacent and within said rim.

4. Apparatus according to claim 3, said base member having an outer central bottom surface that is octagonally configured, including generally veritcal octagonal facets extending between a central lowermost horizontal surface and a radially outer, upwardly inclined outer surface that extends between said facets and said rim.

5. In an evaporative cooler including horizontal, dish-like, generally circular base and cover members; a vertical evaporative pad substantially enclosing, with said cover members, an interior volume of the cooler; air inlet and outlet openings communicating with the interior of the cooler; a blower means, including a drive motor, within the cooler for circulating air through the inlet and outlet openings; and means for continuously supplying water to the upper end of the evaporative pad during cooler operation; the improvement comprising:

a rigid self-supportive, generally cylindrically curved evaporative pad and cover support member having air flow openings therethrough, said pad and cover support member extending between said base and cover members, and comprising the sole means for structurally supporting the cover member above the base member; said airflow openings being separated by narrow, elongated rod-like elements;

a flexible elongated, fibrous, saturable evaporative pad wrapped around the outer periphery of said pad and cover support member and in engagement with the pad and the cover support member;

an elongated, continuous flexible foraminous pad retainer having free ends wrapped around the evaporative pad and the pad and cover support member, said free ends being secured under tension by means of a releasable connector means;

said pad and cover support member comprising the sole means for structurally supporting the cover member above the base member, and comprising a one-piece, curved, semi-rigid element formed of an open mesh network of narrow, rod-like elements;

said air outlet opening comprising a side opening in said pad and cover support element;

said base member including a peripheral upstanding rim sloped outwardly and a lowermost, water retaining bottom area disposed beneath said rim;

a box-like upwardly extending and inwardly tapered flange projecting from the lower most bottom area, said flange terminating above said rim;

said blower mounted on said flange;

said blower having an air discharge opening in communication with the interior of the cooler;

said blower comprising a centrifugal blower including a cylindrical, cage-like rotary impeller having an imperforate central baffle extending radially across the interior of the impeller to divide the blower into two opposed sections.

6. Apparatus according to claim 5, including an upwardly sloping surface connecting the edge of said central lowermost bottom area and the bottom of said rim, said pad and cover support member engaging said base member adjacent and within said rim; said base member having an outer bottom surface that is octagonally configured, including generally vertical octagonal facets extending between a lowermost horizontal surface and a radially outer, upwardly inclined outer surface that extends between said facets and said rim.

7. Apparatus according to claim 1, at least said base and cover members, pad and cover support member, and pad retainer being entirely constructed from nonmetallic material, e.g., fiber reinforced plastic, that is a poor heat conductor.

8. Apparatus according to claim 1, said pad and cover support member comprising annular end members joined by spaced vertical and diagonal strut members, said pad and cover support member being formed from fiber reinforced synthetic resin material.

9. Apparatus according to claim 1, said water supplying means comprising an annular water conduit disposed above said evaporative pad, said conduit having apertures directed towards the upper edge of the pad, and a supply pipe for supplying water to diametrically opposed areas of said annular conduit.

* * * * *